United States Patent [19]

Walker, Jr.

[11] 4,090,605

[45] May 23, 1978

[54] SAFETY MATCHBOOK

[76] Inventor: Wilmer David Walker, Jr., 1316 Sharon St. NW., Atlanta, Ga. 30314

[21] Appl. No.: 690,953

[22] Filed: May 28, 1976

[51] Int. Cl.[2] ..... A24F 27/00

[52] U.S. Cl. ..... 206/110; 206/116

[58] Field of Search ..... 206/90–93, 206/106–108, 110, 112–113, 116

[56] References Cited

U.S. PATENT DOCUMENTS

| | | | |
|---|---|---|---|
| 994,784 | 6/1911 | Pinsuti | 206/110 X |
| 2,136,051 | 11/1938 | Howland | 206/110 |
| 2,192,053 | 2/1940 | Santana et al. | 206/110 |
| 2,260,359 | 10/1941 | Baldwin | 206/110 X |
| 2,263,933 | 11/1941 | Sheridan | 206/110 |
| 2,445,317 | 7/1948 | Duval | 206/110 X |

*Primary Examiner*—Steven E. Lipman

*Attorney, Agent, or Firm*—Jones, Thomas & Askew

[57] ABSTRACT

A safety matchbook including a matchbook having a front and a back, a carrier between the front and back, matches extending from the carrier, and a striking surface on which the matches can be struck, the matchbook being arranged for exposure of less than all the matches for selecting one of the matches, and for enclosing the matches while a match is being struck on the striking surface.

3 Claims, 6 Drawing Figures

SAFETY MATCHBOOK

This invention relates to safety matches and the like, and is more particularly concerned with a safety matchbook having means to prevent inadvertent conflagration of the entire matchbook.

Safety matches have long been known and have achieved great popularity. In spite of the name, however, safety matches are relatively dangerous due to the manner of packaging. The most popular safety matches are the matches made of paper or the like and packaged in a simple fold-over matchbook having a striking surface on the outside of the matchbook. In the past, such matchbooks have been dangerous because of the presence of the striking surface for the matches on the front of the matchbook. With such an arrangement, if the cover of the matchbook is not closed during striking of a match, the entire pack of matches can be easily ignited. More recently, the striking surface has been placed on the back of the matchbook to lessen the danger of the inadvertent conflagration, but there are still numerous incidents of injury due to the ignition of all of the matches in a matchbook.

Some efforts have been made to render a matchbook relatively safe, but the resulting packages have generally been rather complex, rendering them difficult and expensive to manufacture. Even so, many of the prior art matchbooks have failed to consider the importance of attempting to prevent the inadvertent ignition of all of the matches in a matchbook. Prior art devices have thus been arranged so sparks that result from the striking of one match could ignite the remaining matches unless due care is exercised by the person striking the match.

The present invention overcomes the above mentioned and other difficulties with the prior art by providing a safety matchbook having means to assure that the matches and the striking surface are exposed only one at a time so that the matches are exposed for a single match to be selected, then the matches are covered and the striking surface is exposed for striking the one match. In one form of the invention the matchbook is constructed such that a carrier is moved in one direction to expose a limited number of matches for a match to be removed from the carrier, then the carrier must be moved in the opposite direction to expose the striking surface and thereby cover the matches. In another form of the invention, one will normally grasp the area that includes the striking surface in order to select a match, then will normally grasp the matchbook in such a way as to close and lock the matchbook in order to strike the match. In both general forms of the invention, therefore, the arrangement is such that most of the matches are not positioned to be ignited while one match is being struck. Furthermore, the covering of the bulk of the matches during the striking of one match is not dependent on the person striking the match, but is a requirement of the matchbook itself. In addition, the matchbooks made in accordance with the present invention are simple and inexpensive to manufacture, and are adaptable to existing manufacturing techniques. The matchbooks are designed to be simple to use and reliable in operation and are subject to use as an advertising vehicle as are the currently used matchbooks.

These and other features and advantages of the present invention will become apparent from consideration of the following specification when taken in conjunction with the accompanying drawings in which.

Figure 1:
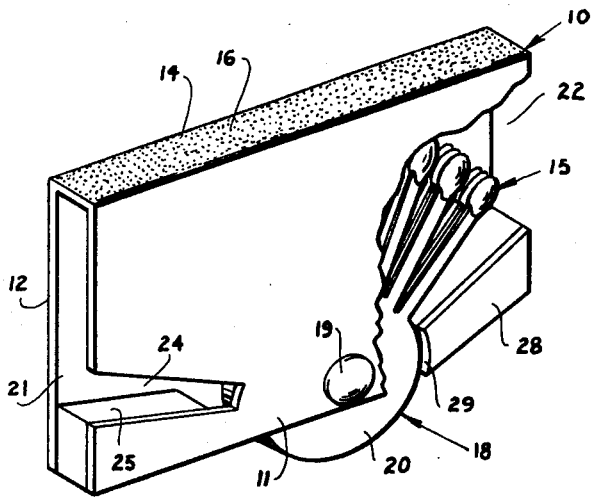
FIG. 1 is a perspective view showing a safety matchbook made in accordance with one aspect of the present invention, the cover thereof being partially broken away to show the construction.

Referring now more particularly to the drawings, and to those embodiments of the invention here chosen by way of illustration it will be seen in FIG. 1 that the device includes a cover generally indicated at 10, the cover 10 having a front 11, a back 12 and a top 14. The front 11 and back 12 lie in planes generally parallel to each other with a plurality of matches 15 disposed between the front 11 and back 12, and in a plane generally parallel to the front and back. The top 14 is generally perpendicular to the front 11 and back 12 and connects the upper edge of the front and back. As here shown, the top 14 also carries the striking surface 16 for striking one of the matches 15.

The matches 15 are formed integrally with a carrier 18. At this point it should be understood that it is contemplated that the entire safety matchbook would be formed of paper, card stock or the like. It is typical in safety matchbooks that a plurality of matches extend from a base, or carrier, a plurality of the carriers being juxtaposed on one another to increase the number of matches in a given matchbook. Generally the same system is contemplated in the present invention, the carrier 18 being, if desired, made up of a plurality of layers with each layer having a plurality of matches 15 extending therefrom.

It will be noted that the carrier 18 is here shown as generally circular in configuration and having a brad 19 extending therethrough. It will be seen that the brad 19 passes through an appropriate opening in the front 11, then passes through the carrier 18 and through a hole in the back 12. As is typical, the brad 19 would be provided with a head on one end and be appropriately swaged on the other end to hold the brad 19 in position. With this construction it will be understood that the brad 19 is secured in the front 11 and back 12 to act as an axle, or axis, for the carrier 18 to rotate therearound.

From the foregoing, it will be seen that the carrier 18 is rotatable with respect to the cover 10 to dispose the matches 15 at various positions between the front 11 and back 12. To facilitate this motion, it will be observed that the lower portion 20 of the carrier 18 extend beyond the front and back 11 and 12 so that a knob-like extension is provided for easy manipulation.

It should now be considered that the matchbook 10 has a dispensing side 21 and a storage side 22. When the carrier 18 is rotated to expose the matches 15 adjacent to the dispensing side 21, it will be understood that the endmost matches of the matches 15 will be substantially aligned with a dispensing slot 24 provided in the cover 11. The dispensing slot 24 extends generally radially of the circular carrier 18 and is formed with sufficient width to allow a person to bend a match from the plane of the carrier 18 upwardly, through the slot 24 so that the match 15 can be torn off at its base, separated from the carrier 18. Also, it should be noted that there is a dispensing stop 25 placed contiguously with the slot 24, the arrangement being such that the matches 15 can be rotated about the brad 19 until the endmost match 15 engages the stop 25. In this position, the endmost match will be aligned with the slot 24 for removal of a match through the slot 24.

Looking now at the storage side 22 for the matches 15, it will be seen that there is a storage stop 28 secured between the front 11 and the back 12 at the lower end of the storage side 22. There is a space 29 between the storage stop 28 and the carrier 18 to allow free rotation of the carrier 18 with respect to the stop 28. It will thus be seen that the carrier 18 can be rotated, carrying with it the matches 15, until the endmost match of the matches 15 engages the stop 28. The matches 15 will then be in the storage condition.

Though it will be understood that a striking surface can be placed on any surface desired of the matchbook 10, the arrangement here shown includes the striking surface 16 along the narrow top 14. While the striking surface 16 is always available for striking a match, it will be seen that a small child or other relatively uncoordinated person would find it most difficult to strike a match on the striking surface 16. The safety matchbook 10 therefore provides additional security against the striking of a match by one who ought not to be striking a match. Furthermore, even if a match is struck without returning the matches to the storage side 22, only a small amount of the matches can be exposed which further reduces the hazard.

Figure 2:
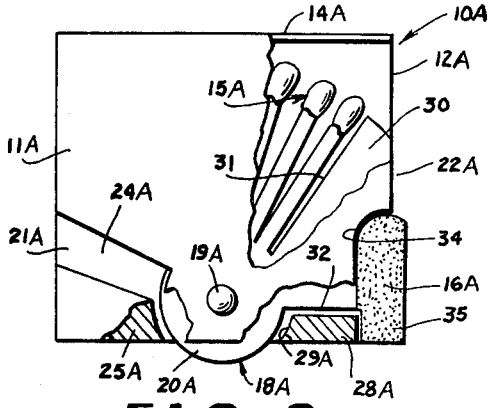
FIG. 2 is a front elevational view of a modified form of the safety matchbook shown in FIG. 1 of the drawings, the cover thereof being partially broken away to show the constructional details.

Attention is next directed to FIG. 2 of the drawing which shows a modified form of the matchbook 10. Since many of the features of the matchbook shown in FIG. 2 are the same as the matchbook shown in FIG. 1, the same reference numerals are applied but having an A suffix. It will therefore be seen that the matchbook 10A has a front 11A and a back 12A, the front and back being connected by a top 14A. A carrier 18A is secured between the front 11A and the back 12A by a brad 19A, the carrier 18A being freely rotatable about the brad 19A. There is a plurality of matches 15A extending from the carrier 18A and lying between the front 11A and the back 12A. A stop 25A is arranged at the dispensing end 21A so that when the endmost match of the matches 15A engages the stop 25A, one of the matches 15A will be aligned with the dispensing slot 24A so that a match can be torn from the carrier 18A.

The principal difference between the matchbook 10A and the matchbook 10 is on the storage side 22A. In FIG. 2 is will be seen that the carrier 18A has connected thereto a shield 30. The shield 30 extends from the carrier 18A and has its inner edge 31 extending generally parallel to the endmost match of the matches 15A. The shield 30 substantially fills the corner of the storage side 22A and includes a notch 32 to receive the stop 28A.

It should also be seen that the front 11A is cut out as at 34; and, since the shield 30 has an extension at 35 that extends beyond the cover 11A, between the notch 34 and the extension 35 there is sufficient room to provide the striking surface 16A, the striking surface 16A being physically carried by the shield 30.

From the foregoing, it should now be seen that the matchbook 10A shown in FIG. 2 of the drawings is so constructed that one would be required to manipulate the lower portion 20A of the carrier 18A to cause the matches 15A to rotate around so that one of the matches 15A is aligned with the dispensing slot 24A for a match to be removed. However, when the matches 15A are so rotated, it will be seen that the striking surface 16A is carried by the shield 30 so the striking surface 16A will be enclosed within the matchbook 10A, lying between the front 11A and the back 12A. As a result, before one can strike the match 15A the lower portion 20A of the carrier 18A must again be manipulated to rotate the entire structure to place the matches 15A in the storage position in which the striking surface 16A is within the slot 34. Since the matches 15A and the striking surface 16A are not exposed at the same time, inadvertent conflagration of the matchbook 10A is highly unlikely.

Figure 3:
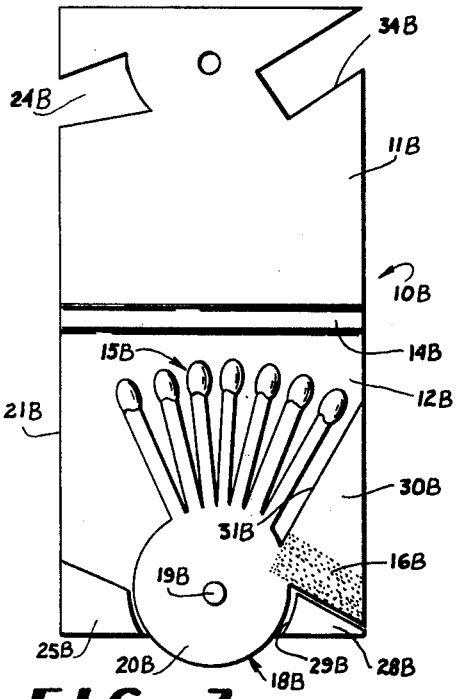
FIG. 3 is an elevational view of another modified form of the safety matchbook in FIG. 1, the cover of the matchbook being shown in flat condition to reveal the structure of the device.

Looking next at FIG. 3 of the drawings, another modification of the matchbook 10 is disclosed, and various parts of the matchbook shown in FIG. 3 are designated with the same reference numerals having a B suffix. The matchbook 10B shown in FIG. 3 of the drawings is shown with the front 11B opened to lie in the same plane as the back 12B. It should be understood that the matchbook 10B is so shown for purposes of illustration only and that, normally, the front 11B would be prevented from opening because of the brad 19B that would secure the cover 11B in fixed position with respect to the back 12B with the carrier 18B therebetween as described in connection with the embodiments shown in FIGS. 1 and 2 of the drawings.

The matchbook 10B shown in FIG. 3 of the drawings is substantially the same as the matchbook 10A shown in FIG. 2 of the drawings so that the description of FIG. 3 will be relatively brief. It will be seen in FIG. 3 that the matchbook 10B has the carrier 18B with a plurality of matches 15B extending therefrom; and, there is a shield 30B also extending from the carrier 18B. The principal difference, then, is the geometrical arrangement of the shield 30B and the notch 34B for exposing the striking surface 16B through the front 11B.

It will be understood that, in the embodiment shown in FIG. 2 of the drawings, in order to strike a match one would generally move the match in the direction from the top 14A towards the bottom of the matchbook 10A, that is away from the matches 15A. Similarly, in the matchbook 10B shown in FIG. 3 of the drawings, it will be seen that the striking surface 16B is oriented as along a secant of the carrier 18B with one extremity of the striking surface 16B in the lower corner of the matchbook 10B. As a result of this arrangement, it will be seen that the most appropriate, and most logical, direction for the striking of a match would be from the vicinity of the carrier 18B towards the corner of the matchbook 10B, again away from the matches 15B.

It will thus be seen that the embodiment of the invention shown in FIG. 3 of the drawings would require that one rotate the carrier 18B by manipulating the lower portion 20B to carry the matches 15B towards the dispensing end 21B. When the endmost match engages the stop 25B, the endmost match will be substantially aligned with the dispensing slot 24B. In this condition, a match can be removed by tearing from the carrier 18B; however, while the matches 15B are in the dispensing position the striking surface 16B is contained within the matchbook 10B, located between the front 11B and the back 12B. In order to strike the match 15B, it will therefore be seen that the carrier 18B must again be rotated in the opposite direction until the shield 30B engages the stop 28B so that the striking surface 16B will be aligned with the notch 34B in the cover 11B.

Figure 4:
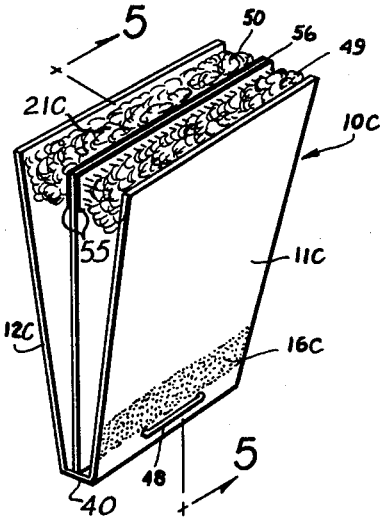
FIG. 4 is a perspective view of a safety matchbook made in accordance with a different aspect of the present invention.
Figure 5:
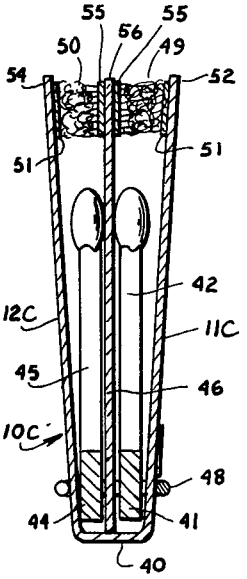
FIG. 5 is a cross - sectional view taken substantially along the line 5—5 in FIG. 4; and, FIG. 6 is a pictorial representation showing a safety matchbook of the type shown in FIG. 4 of the drawings as the matchbook would be held for striking a match.

Attention is next directed to FIGS. 4 and 5 of the drawing which show a different form of the present invention. The matchbook 10C shown in FIGS. 4 and 5 of the drawings includes a front 11C, the same piece of material being folded around to form a bottom 40, and again folded to form the back 12C. In this embodiment of the invention it will be seen that there is a first carrier 41 having matches 42 extending therefrom generally parallel to the front 11C and there is a second carrier 44 having matches 45 extending therefrom generally parallel to the back 12C. Between the first carrier 41 and the second carrier 44, there is a median wall 46 that is substantially coextensive with the front 11C and the back 12C. A staple 48, or similar fastening means, passes through the front 11C, through both the first carrier 41 and the second carrier 44 and through the median wall 46 and the back 12C. Thus, the entire assembly is fastened together by a single fastening means such as the staple 48.

To allow a match to be removed from the matchbook 10C, there are separable fastening means 49 and 50, the fastening means 49 being located between the front 11C and the median wall 46 and the fastening means 50 being located between the median wall 46 and the back 12C. Though numerous forms of fastening means may be devised, the fastening means here shown is in the form of a hook and teasel well known in the art, and popularly sold under the trademark "Velcro". Using a hook and teasel type of fastening means 49 and 50, it will be understood that the teasel 51 is fixed to the front 11C and a strip of teasel 51 is fixed to the back 12C. The strips 51 are secured along the uppermost edge 52 and 54 of the front and back 11C and 12C respectively. Mounted parallel to the strip 51, there are strips 55 of the hook member that is complementary to the teasel 51. It will be seen that the strips 55 of the hooks are secured along the uppermost edge 56 of the median wall 46. All parts of the fastening means are preferably mounted so that the matches will not engage the fastening means to assure that the matches will not be inadvertently ignited.

Figure 6:
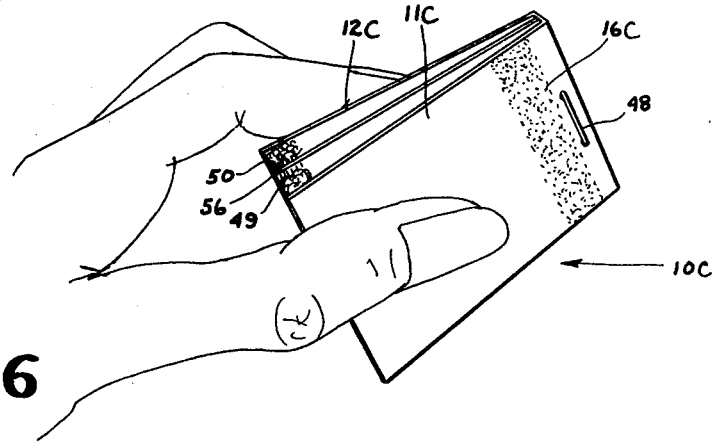

It will now be understood that the separable fasteners 49 and 50 will secure the dispensing end 21C of the matchbook 10C together; however, with intentional manipulation one can separate the teasel 51 from the hook 55 so that the front (for example) can be moved away from the matches 42 sufficiently to remove one of the matches 42 from the carrier 41. It should be noted, however, that the striking surface 16C is along the lower edge of the front 11C. Due to the necessity for opening the upper end of the matchbook 10C, it will be understood that one would normally grasp the matchbook 10C in the vicinity of the striking surface 16C in order to remove a match. As a result, the match cannot be struck while one is so holding the matchbook 10C. With special attention to FIG. 6 of the drawings, it will be understood that a person will normally turn the matchbook 10C around and grasp the matchbook as shown in FIG. 6, that is, by the upper portion so that pressure would be applied directly across the separable fasteners 49 and 50. Since only slight pressure is required to engage the hook member 55 with the teasel 51, and since one must grasp the matchbook 10C sufficiently tightly to hold the matchbook against inadvertent motion while a match is struck, a person will automatically secure the matchbook 10C while attempting to strike a match. The natural result is that one will open one side of the matchbook 10C in order to remove a match 42 or 45 from its carrier 41 or 44; then, the person will allow the matchbook 10C to be closed and will grasp the upper edge of the matchbook thereby securing the separable fasteners 49 and 50 while striking the match so that, as before, the matches will not be exposed while a match is being struck.

From the foregoing it will be understood by those skilled in the art that the present invention provides a safety matchbook wherein one or more matches is exposed to allow a person to remove a match from a carrier. In all cases, a limited number of matches is exposed to reduce the hazard immediately; and, the arrangement is such that it is unlikely that a match will be struck while even the limited number of matches is exposed. In one form of the invention the matches are required to be rotated into a storage position in order to expose the striking surface while in another form of the invention the arrangement is such that a person will naturally tend to close the matchbook because of the location of the striking surface.

It will of course be understood that the embodiments of the invention here disclosed are shown by way of illustration only and are meant to be in no way restrictive; therefore, numerous changes and modifications may be made and the full use of equivalents resorted to without departing from the spirit or scope of the invention as defined in the appended claims.

I claim:

1. A matchbook comprising:

(a) a cover having a first face and a second face, top and bottom surfaces and having a substantially open first side and a substantially open second side, said first face of said cover having a match removal opening extending radially from the mid-portion of said first face toward said first side of said cover and further having a match striking opening substantially adjacent said second side of said cover;

(b) a match carrier including a plurality of matches extending radially in a flat group from said carrier, a match striking surface in a position on said carrier remote from said plurality of matches, and a shield surface adjacent said plurality of matches between said plurality of matches and said match striking surface, said carrier being rotatably mounted in said cover in an arrangement such that said carrier may be rotated into a first position wherein the match most closely positioned in said plurality of matches toward said first side can be rotated into registration with said removal opening and said carrier may be rotated into a second position wherein the match most closely positioned in said plurality of matches toward said first side is substantially remote from said removal opening and from said first side of said cover, said shield surface is positioned between said plurality of matches and said second side, and said striking surface is in registration with said match striking opening;

(c) a first stop means in said cover for preventing the rotation of said match carrier beyond said first position to a position in which the matches positioned inwardly of said match most closely positioned in said plurality of matches toward said first side can be in registration with said match removal opening thereby insuring that only the match most closely positioned toward said first side may be removed; and (d) a second stop means in said cover for preventing the rotation of said match carrier past said second position into a position in which said match striking surface is in registration with said match striking opening and said shield surface is not positioned between said plurality of matches and said second side of said cover thereby preventing exposure of said plurality of matches when said match striking surface is in registration with said match striking opening.

2. A matchbook comprising:

(a) a cover having a first face and a second face, top and bottom surfaces and having a substantially open first side and a substantially open second side, said first face of said cover having a match removal opening extending radially from the mid-portion of said first face toward said first side of said cover and said second face of said cover having a match striking opening substantially adjacent said second side of said cover;

(b) a match carrier including a plurality of matches extending radially in a flat group from said carrier, a match striking surface in a position on said carrier remote from said plurality of matches, and a shield surface adjacent said plurality of matches between said plurality of matches and said match striking surface, said carrier being rotatably mounted in said cover in an arrangement such that said carrier may be rotated into a first position wherein the match most closely positioned in said plurality of matches toward said first side can be rotated into registration with said removal opening in said first face of said cover and said carrier may be rotated into a second position wherein the match most closely positioned in said plurality of matches toward said first side is substantially remote from said removal opening in said first face of said cover and from said second side of said cover, said shield surface is positioned between said plurality of matches and said second side, and said striking surface is in registration with said match striking opening in said second face of said cover;

(c) a first stop means in said cover for preventing the rotation of said match carrier beyond said first position to a position in which the matches positioned inwardly of said match most closely positioned in said plurality of matches toward said first side can be in registration with said match removal opening thereby insuring that only the match most closely positioned toward said first side may be removed; and (d) a second stop means in said cover for preventing the rotation of said match carrier past said second position into a position in which said match striking surface is in registration with said match striking opening and said shield surface is not positioned between said plurality of matches and said second side of said cover thereby preventing exposure of said plurality of matches when said match striking surface is in registration with said match striking opening.

3. A safety matchbook comprising:

a matchbook cover including a front, a back, a top portion, a bottom portion, and having a dispensing side and a storage side;

means for retaining said front and said back of said matchbook cover in juxtaposed parallel relationship;

a match carrier disposed in said matchbook cover between said front and said back;

a plurality of matches extended from said carrier, said plurality of matches being enclosed within said matchbook cover between said front and said back;

means for rotatably fixing said carrier to said matchbook cover;

means for selectively moving said plurality of matches from said storage side to said dispensing side and from said dispensing side to said storage side, said means for moving comprising a portion of said carrier extending from said matchbook cover;

a dispensing slot defined in said front of said matchbook cover at said dispensing side;

said matchbook cover including dispensing stop means adjacent said slot for aligning at least one of said plurality of matches with said dispensing slot and for limiting movement of said plurality of matches in said matchbook cover toward said dispensing side;

said matchbook cover including storage stop means for limiting movement of said plurality of matches in said match book cover toward said storage side; and a shield carried by said match carrier and moveable with said carrier, a striking surface located on said shield, said shield being so constructed and arranged with respect to said matchbook cover that said striking surface is enclosed within said matchbook cover when said plurality of matches is at said dispensing side and said striking surface is outside said matchbook when said plurality of matches is at said storage side.

* * * * *